US011378325B2

(12) United States Patent
Berkhout

(10) Patent No.: US 11,378,325 B2
(45) Date of Patent: Jul. 5, 2022

(54) REFRIGERATOR WITH NOISE REDUCTION

(71) Applicant: THETFORD BV, Etten-Leur (NL)

(72) Inventor: Pieter Dirk Berkhout, Dordrecht (NL)

(73) Assignee: Thetford BV, Etten-Leur (NL)

( * ) Notice: Subject to any disclaimer, the term of this patent is extended or adjusted under 35 U.S.C. 154(b) by 45 days.

(21) Appl. No.: 16/897,346

(22) Filed: Jun. 10, 2020

(65) Prior Publication Data

US 2021/0010737 A1 Jan. 14, 2021

Related U.S. Application Data

(60) Provisional application No. 62/873,283, filed on Jul. 12, 2019.

(51) Int. Cl.

| | |
|---|---|
| ***F25D 17/06*** | (2006.01) |
| ***F25B 13/00*** | (2006.01) |
| ***F25D 23/00*** | (2006.01) |

(52) U.S. Cl.

CPC ..... *F25D 17/065* (2013.01); *F25B 13/00* (2013.01); *F25D 23/006* (2013.01)

(58) Field of Classification Search

CPC ..... F25D 17/065; F25D 23/006; F25D 11/02; F25D 23/003; F25D 23/06; F25D 23/066; F25D 23/10; F25B 13/00

See application file for complete search history.

(56) References Cited

U.S. PATENT DOCUMENTS

| | | | | |
|---|---|---|---|---|
| 1,381,056 A | | 6/1921 | Blakely | |
| 2,108,478 A | | 2/1938 | Eaker et al. | |
| 2,236,111 A | | 3/1941 | Philipp | |
| 2,254,837 A | | 9/1941 | Burns | |
| 2,672,029 A | * | 3/1954 | Saunders | F25D 11/02 62/297 |
| 2,932,956 A | | 4/1960 | Chieregatti | |

(Continued)

FOREIGN PATENT DOCUMENTS

| | | | |
|---|---|---|---|
| CN | 201730803 U | | 2/2011 |
| EP | 0718570 A2 | * | 6/1996 |

(Continued)

OTHER PUBLICATIONS

EP0718570A2 translation.*
EP2604958A2 translation.*

*Primary Examiner* — Elizabeth J Martin
(74) *Attorney, Agent, or Firm* — Harness, Dickey & Pierce, P.L.C.; Stephen T. Olson

(57) ABSTRACT

A refrigerator has a component subassembly incorporating a plurality of refrigeration components along an airflow path that extends between an inlet for colder air and an outlet for warmer air. The refrigerator further includes a noise reduction arrangement for reducing an operating noise of the refrigerator having a plurality of walls defining the airflow path. The walls include a noise absorbing material. The plurality of walls includes a plurality of external walls and a plurality of internal walls. The plurality of external walls defines an outer perimeter of the component subassembly and are oriented generally orthogonal to one another. The internal walls of the plurality of internal walls may be skewed relative to the external walls of the plurality of external walls. At least some of the walls of the plurality walls may be load-bearing walls.

18 Claims, 5 Drawing Sheets

(56) References Cited

U.S. PATENT DOCUMENTS

| | | | | |
|---|---|---|---|---|
| 3,091,288 | A | 5/1963 | Williams | |
| 3,162,023 | A * | 12/1964 | Smith | F25D 23/003 62/455 |
| 4,264,282 | A | 4/1981 | Crago | |
| 5,313,803 | A | 5/1994 | Detzer | |
| 6,790,012 | B2 | 9/2004 | Sharp et al. | |
| 7,549,505 | B1 | 6/2009 | Kawar | |
| 7,845,483 | B2 | 12/2010 | Noguchi et al. | |
| 2011/0061416 | A1 * | 3/2011 | Rothmund | F25D 23/003 62/291 |
| 2012/0108160 | A1 | 5/2012 | Zhou et al. | |
| 2018/0172335 | A1 * | 6/2018 | Avhale | F25D 23/003 |
| 2019/0049169 | A1 * | 2/2019 | Ciyanoglu | F25D 23/028 |

FOREIGN PATENT DOCUMENTS

| | | | |
|---|---|---|---|
| EP | 0718570 | A2 | 6/1996 |
| EP | 2604958 | A2 * | 6/2013 |

* cited by examiner

REFRIGERATOR WITH NOISE REDUCTION

CROSS REFERENCE TO RELATED APPLICATION

This application claims priority to U.S. Patent Application No. 62/873,283 filed 12 Jul. 2019, which application is herein expressly incorporated by reference.

FIELD

The present disclosure relates generally to refrigerators and, more particularly, to a refrigerator for recreational vehicles such as a compressor refrigerator with noise reduction.

BACKGROUND

This section merely provides background information related to the present disclosure and may not constitute prior art.

Vehicles, including but not limited to, recreational vehicles ("RVs", in the United States and "Caravans" in Europe), tractor trailers, airplanes, boats, trains and the like, often incorporate refrigerators for the comfort and convenience of the occupants. For example, recreational vehicle campers often find it convenient, or even necessary, to refrigerate food, drinks, and medicine during their journey and while at their campsites. While many prepared camp sites in parks and commercial campgrounds provide for electrical outlets, many do not. Moreover, many highly desirable camping locations exist outside of these prepared sites. Thus, a popular solution has been to equip the recreational vehicle with a built-in refrigerator.

It is generally known to use both compressor refrigerators and absorption refrigerators for mobile applications. Compressor refrigerators are typically able to chill to lower temperatures and cool more consistently than absorption refrigerators regardless of the outside ambient temperature due to the more powerful compressor motor. Compressor refrigerators, however, are generally associated with a greater degree of operating noise. The greater operating noise comes from running of the compressor.

Known refrigerators for mobile applications and the like have proven to be generally suitable for their intended purposes. A close proximity with vehicle occupants, however, raises particular issues relating to the noise created during normal operation of such a refrigerator, particularly for compressor refrigerators. For example, the noise created by a conventional mobile refrigerator may be undesirable to vehicle occupants sleeping in close proximity to the refrigerator. Accordingly, it remains an on-going need in the art to further reduce the operating noise generated by mobile refrigerators and other refrigerators.

SUMMARY

This section provides a general summary of the disclosure, and is not a comprehensive disclosure of its full scope or all of its features.

The present teachings provide a refrigerator having a cabinet, at least one door and a plurality of refrigeration components. The cabinet defines an interior volume including at least one cooling compartment. The at least one door is carried by the cabinet and provides access to the interior volume. The plurality of refrigeration components includes a compressor, a condenser and a fan. The refrigerator additionally includes a component subassembly incorporating the plurality of refrigeration components and an airflow path extending between an inlet for colder air and an outlet for warmer air. The refrigeration components are located along the airflow path. The refrigerator further includes a noise reduction arrangement for reducing an operating noise of the refrigerator. The noise reduction arrangement including a plurality of walls defining the airflow path. The plurality of walls includes a plurality of external walls and a plurality of internal walls. The plurality of external walls defines an outer perimeter of the component subassembly and are oriented generally orthogonal to one another.

According to one particular aspect of the present teachings, the walls defining the airflow path include a noise absorbing material.

According to another particular aspect of the present teachings, the internal walls of the plurality of internal walls are skewed relative to the external walls of the plurality of external walls.

According to still yet another particular aspect of the present teachings, at least some of the walls of the plurality walls are load-bearing walls.

Further areas of applicability will become apparent from the description provided herein. The description and specific examples in this summary are intended for purposes of illustration only and are not intended to limit the scope of the present disclosure.

DRAWINGS

The present teachings will become more fully understood from the detailed description, any appended claims and the following drawings. The drawings are for illustrative purposes only and are not intended to limit the scope of the present disclosure.

DETAILED DESCRIPTION

Figure 1:
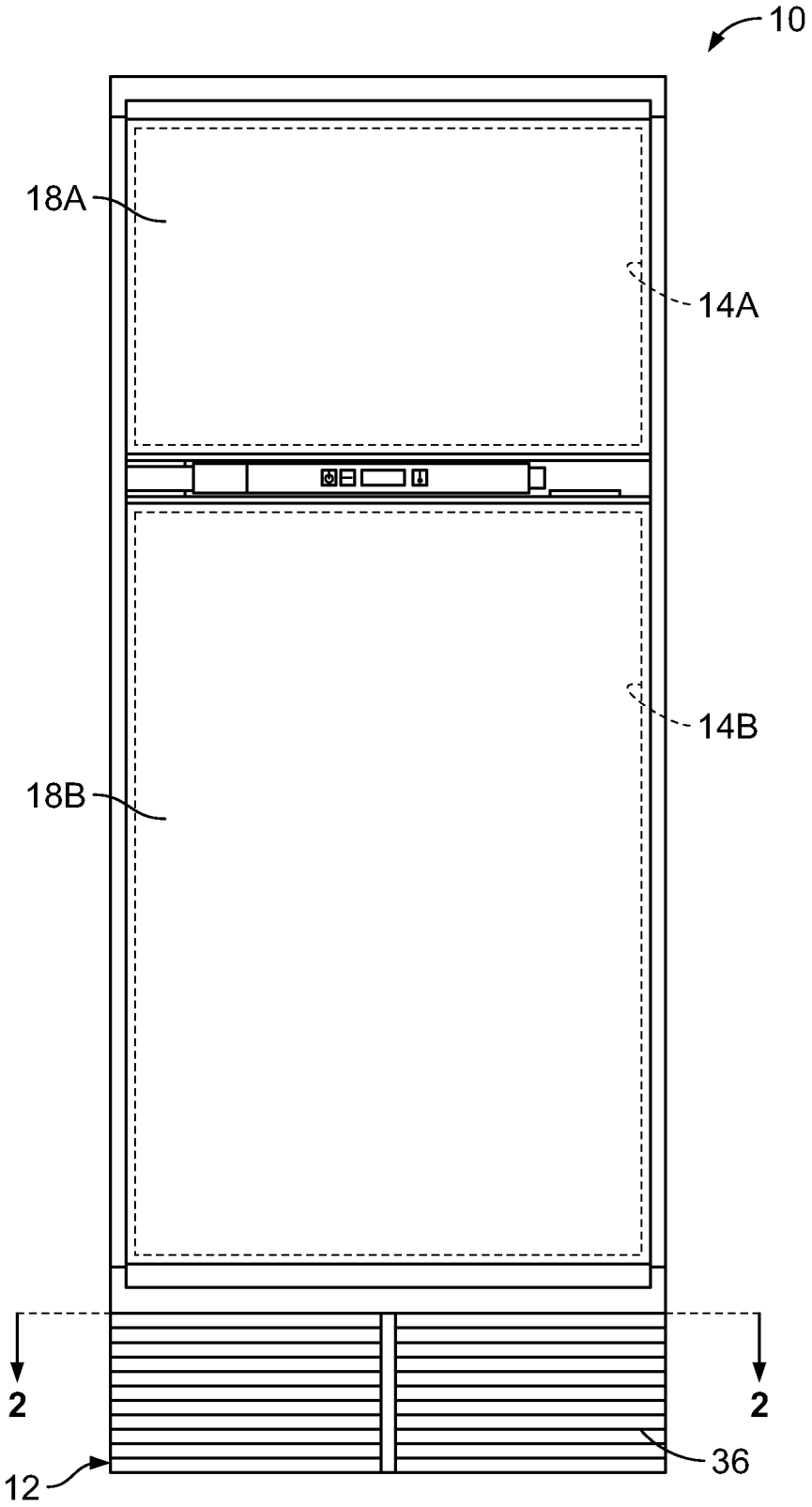
FIG. 1 is a front view of a mobile refrigerator incorporating a noise reduction arrangement according to the present teachings.

The following description is merely exemplary in nature and is not intended to limit the present disclosure, its application, or uses. It should be understood that throughout the drawings, corresponding reference numerals indicate like or corresponding parts and features.

With reference to the drawings, a refrigerator constructed in accordance with one example of the present teachings is shown and generally identified at reference numeral 10. As will become apparent below, the refrigerator includes a noise reduction arrangement 12 for reducing the operating noise. In the embodiment illustrated, the refrigerator 10 is a mobile, compressor refrigerator for a recreational vehicle, tractor trailer, airplane, boat, train or the like. The present teachings, however, are not limited to any particular type of refrigerator.

The refrigerator 10 conventionally includes an interior volume 14 in which a user desires to store perishables and other items needing cooling. The interior volume 12 may be defined by a cabinet 16 that is divided into two, or more, sections 14A and 14B with one section being kept cooler than the other interior section. The cabinet 16 provides protection for the various components of the refrigerator 10. At least one door carried by the cabinet 16 for accessing the interior volume 14. As shown, a first door 18A allows the user access to the first section 14A of the interior volume 14 and a second door 18B allows the user access to the second section 14B of the interior volume 12.

The refrigerator 10 includes a plurality of refrigeration components including a condenser 20, a compressor 22, and a fan 24. These elements will be understood to be conventional in construction and function in so far as the present teachings are concerned.

A component subassembly 26 of the refrigerator 10 incorporates the plurality of refrigeration components 20, 22, and 24 and includes an airflow path 28 extending between an inlet 30 for colder air and an outlet 32 for warmer air. The refrigeration components 20, 22, and 24 of the plurality of refrigeration components are located along the airflow path 28. In the embodiment illustrated, the component subassembly 26 is located below a remainder of the refrigerator 10 and may include a floor 34 defining a support surface for the refrigerator 10. The inlet 30 and outlet 32 of the airflow path 28 are positioned at a forward side of the component subassembly 26 and may be covered by a grate 36 (as shown in FIG. 1). The component subassembly 26 eliminates any need for additional installation work for ventilation as the ventilation is integrated into the refrigerator 10. It will be understood, that in alternative applications, the present teachings may be adapted such that the component subassembly 26 is located at an upper end of the refrigerator 10.

The noise reduction arrangement 12 includes a plurality of walls defining the airflow path 28. The plurality of walls includes a plurality of external walls 38 and a plurality of internal walls 40. The plurality of walls vertically extend upward from the floor 34. In the embodiment illustrated, at least some of the walls are load-bearing. At least the external walls are load bearing. In some applications, the internal walls may also be load bearing. Explaining further, the load-bearing walls of the component assembly 26 provide structural integrity by functionally supporting the remainder of the refrigerator 10 on the floor 34 and thereby reducing the overall weight of the refrigerator 10 by eliminating alternative mechanical supports. The condenser 20 may also be used as a functional support between floor 34 and the remainder of the refrigerator 10.

The plurality of internal walls 40 includes a central internal wall 40C and a plurality of angled internal walls 40A. The plurality of external walls 38 defining an outer perimeter of the component subassembly 26 and are oriented generally orthogonal to one another. As such, the component subassembly 26 has a generally rectangular shape with a front side 42, a rear side 44, and first and second lateral sides 46 and 48. The central internal wall 40C is parallel to the first and second lateral sides 46 and 48 and thereby perpendicular to the front and rear sides 42 and 44. The central internal wall 40C divides the flow path 28 into a first portion 28A extending from the inlet 30 toward the rear side 44 and a second portion 28B extending to the outlet 32 from the rear side 44. The angled internal walls 40A extend into the flow path from the central internal wall 40C or from one of the first and second lateral sides 46 and 48 at an angle $\alpha$. In the embodiment illustrated, the angle $\alpha$ is approximately 90 degrees.

The walls of the component subassembly 26 are constructed of a reflective material including but not limited to metal, plastic, wood and the like. The reflective material of the walls increases the length of the path of the soundwaves propagating through the flow path 28. The condenser 20 may also be constructed of a reflective material to still further increase the length of the path of the soundwaves propagating through the flow path 28.

During operation of the refrigerator 10, when the compressor 22 is running, the fan 24 may be used to circulate cooling air along the flow path 28. Operation of the fan 24 draws colder air in at the inlet 30. The cooling air passes the compressor 22 to cool the compressor 22 and exits the flow path 28 at the outlet 32. Operational noise generated by the compressor is reduced by the increased the length of the path of the soundwaves propagating through the flow path 28.

Figure 2:
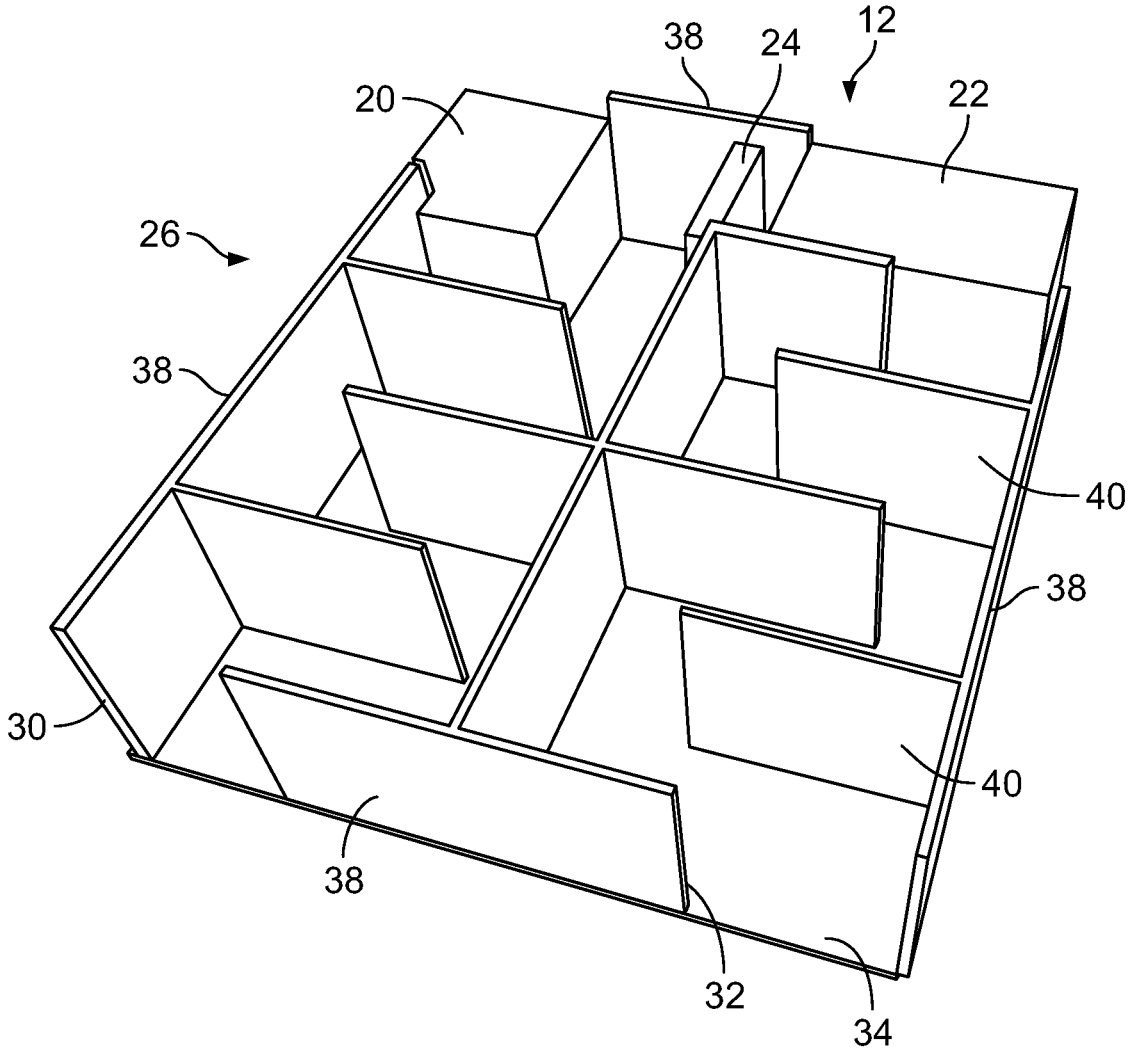
FIG. 2 is a perspective view of the noise reduction arrangement according of FIG. 1 looking generally in the direction of plane 2-2 of FIG. 1 (i.e., with the remainder of the mobile refrigerator removed for purposes of illustration).
Figure 3:
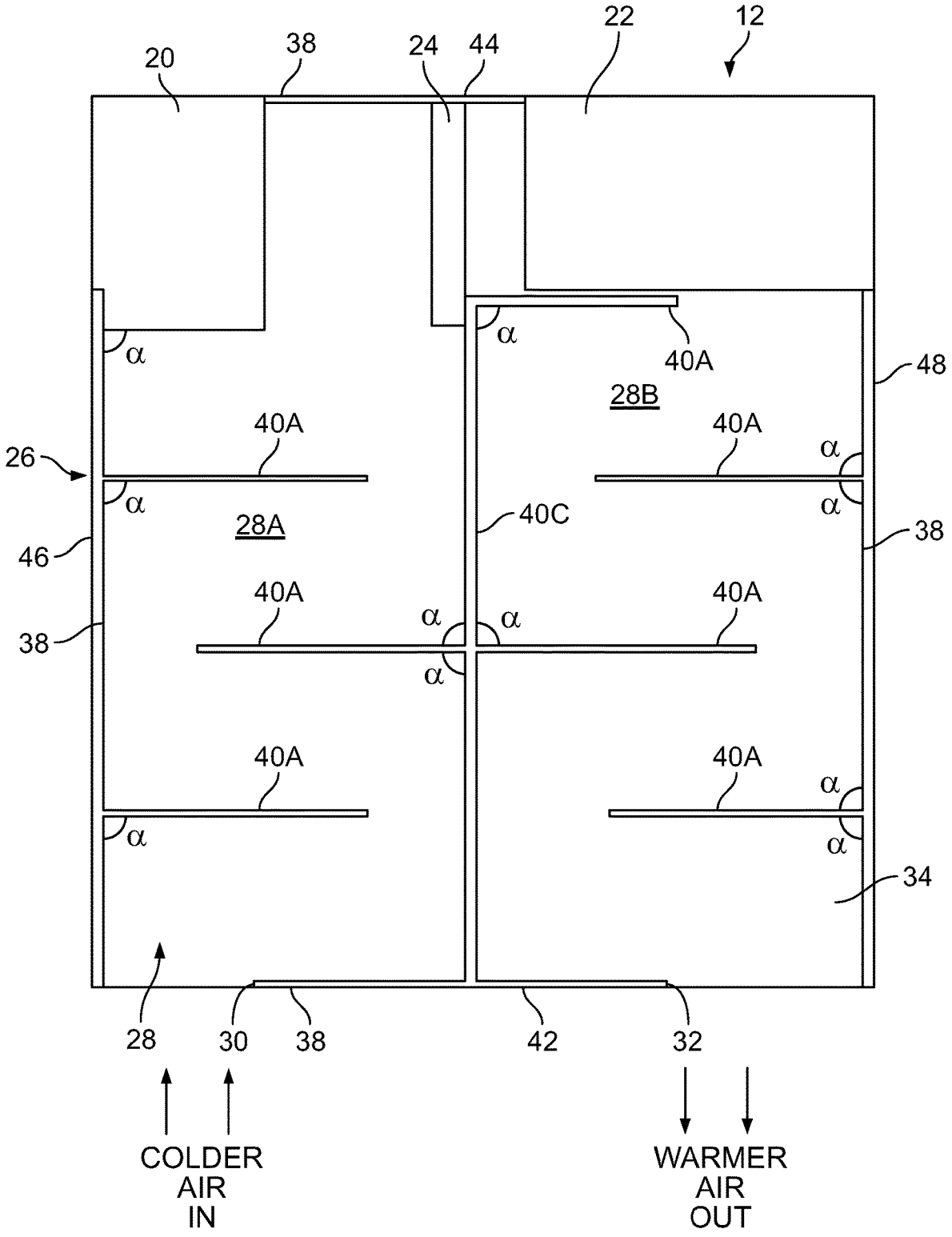
FIG. 3 is a top view of the noise reduction arrangement of FIG. 2.
Figure 4:
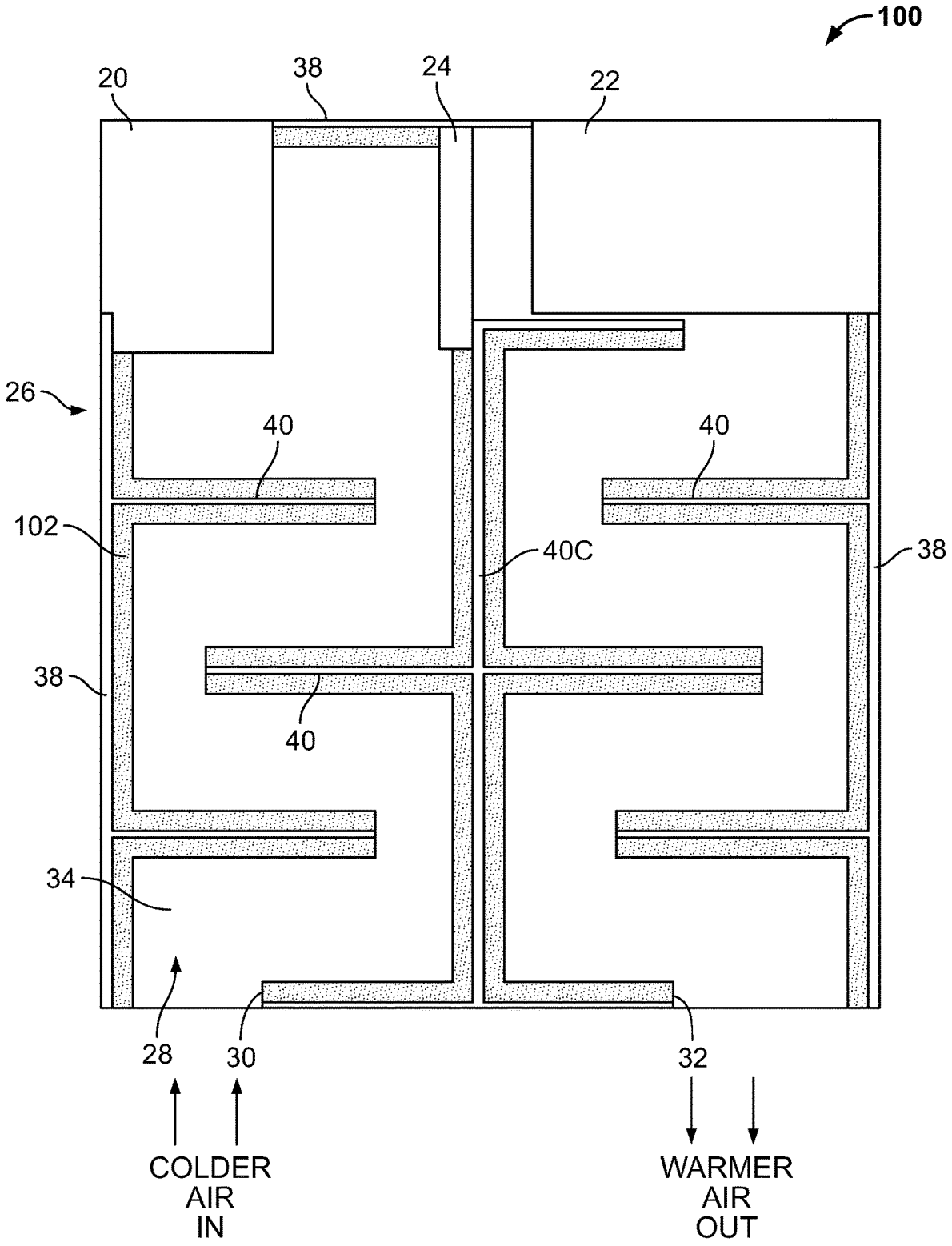
FIG. 4 is top view similar to FIG. 2 illustrating a top another noise reduction arrangement for a mobile refrigerator in accordance with the present teachings.

Turning to FIG. 4, a top view similar to FIG. 2 illustrates another noise reduction arrangement 100 for a mobile refrigerator in accordance with the present teachings. Given the similarities between the embodiment of FIG. 4 and FIGS. 1-3, like reference characters will be used to identify corresponding elements. The noise reduction arrangement 100 primarily differs from the noise reduction arrangement 12 by incorporating a noise absorption material 102 on the walls of the component subassembly 26. The internal and external walls 40 and 38 are lined with noise absorbing material adjacent the flow path 28. The noise absorbing material may be a foam or the like.

Figure 5:
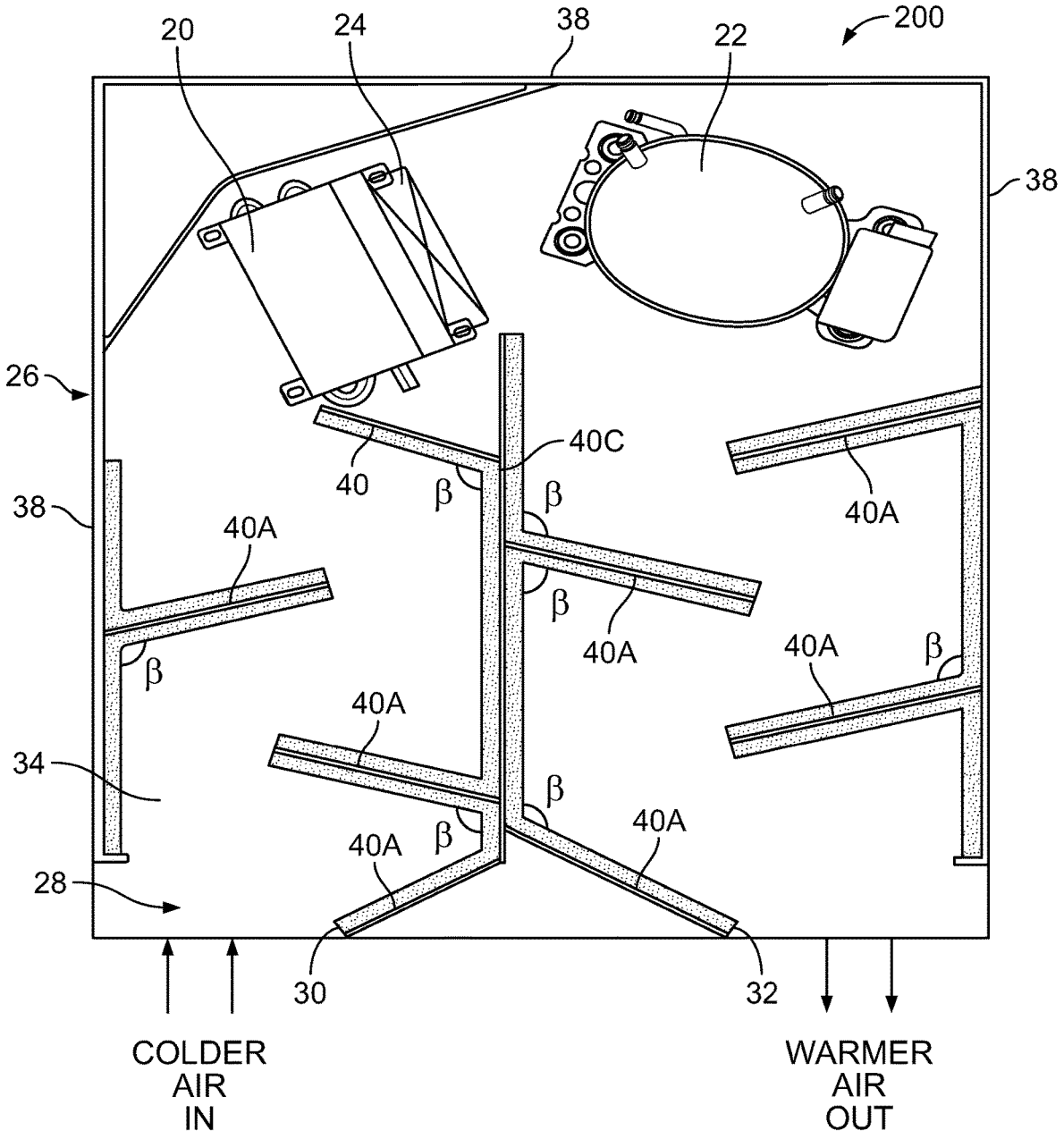
FIG. 5 is another top view similar to FIG. 2 illustrating a top of yet another noise reduction arrangement for a mobile refrigerator in accordance with the present teachings.

Turning to FIG. 5, another top view similar to FIG. 2 illustrates yet another noise reduction arrangement 200 for a mobile refrigerator in accordance with the present teachings. Again, given the similarities between the embodiment of FIG. 5 and previously described embodiments, like reference characters will be used to identify corresponding elements. The noise reduction arrangement 200 primarily differs from the noise reduction arrangement 100 in that angled internal walls 40A of the plurality of internal walls 40 are skewed relative to the external walls of the plurality of external walls 38. The angled internal walls 40A extend into the flow path from the central internal wall 40C or from one of the first and second lateral sides 46 and 48 at an angle $\beta$ as the flow path extends from the inlet 30 to the outlet 32. In the embodiment illustrated, the angle $\beta$ is an obtuse angle. The angle $\beta$ is preferably at least 100 degrees. The angled walls further facilitate the flow of air from the inlet 30 to the outlet 32.

While specific examples have been discussed in the specification and illustrated in the drawings, it will be understood by those skilled in the art that various changes may be made and equivalence may be substituted for elements thereof without departing from the scope of the present teachings. For example, while the present teachings have been described in connection with a mobile compressor refrigerator, the invention is not so limited and may be extended to other applications. Furthermore, the mixing and matching of features, elements and/or functions between various examples may be expressly contemplated herein so that one skilled in the art would appreciate from the present teachings that features, elements and/or functions of one example may be incorporated into another example as appropriate, unless discussed otherwise above. Moreover, many modifications may be made to adapt a particular situation or material to the present teachings without departing from the essential scope thereof. Therefore, it may be intended that the present teachings not be limited to the particular examples illustrated by the drawings and discussed in the specification as the best mode of presently contemplated for carrying out the present teachings but that the scope of the present disclosure will include any embodiments following within the foregoing description and any appended claims.

What is claimed is:

1. A refrigerator comprising:

a plurality of refrigeration components including a compressor, a condenser and a fan;

a component subassembly incorporating the plurality of refrigeration components and including an airflow path extending between an inlet for colder air and an outlet for warmer air, the plurality of refrigeration components located along the airflow path; and a noise reduction arrangement for reducing an operating noise of the refrigerator, the noise reduction arrangement including a plurality of walls defining the airflow path and defining an outer perimeter of the component subassembly, wherein the plurality of walls includes a plurality of internal walls and a plurality of external walls, the plurality of internal walls includes a central internal wall and a plurality of angled internal walls, the plurality of angled internal walls being skewed relative to the central internal wall.

2. The refrigerator of claim 1, wherein the walls of the plurality of walls include a noise absorbing material.

3. The refrigerator of claim 1, wherein the walls of the plurality of walls are further constructed of a reflective material to increase a length of a path of soundwaves propagating through the airflow path.

4. The refrigerator of claim 1, further comprising:

a cabinet that defines an interior volume, the interior volume defining at least one cooling compartment;

at least one door carried by the cabinet for accessing the interior volume;

wherein the component subassembly is located below the at least one cooling compartment and at least some of the walls of the plurality of walls are load bearing walls.

5. The refrigerator of claim 4, wherein at least some of the external walls are load bearing.

6. The refrigerator of claim 4, wherein at least some of the internal walls are load bearing.

7. The refrigerator of claim 4, wherein at least some of the external walls and some of the internal walls are load bearing.

8. The refrigerator of claim 4, wherein the condenser is disposed within the refrigerator in a load bearing manner to cooperate with the plurality of walls to support a weight of the refrigerator.

9. The refrigerator of claim 1, wherein the plurality of angled internal walls extend into the airflow path at obtuse angles.

10. The refrigerator of claim 1, wherein the plurality of external walls define an outer perimeter of the component subassembly and are oriented generally orthogonal to one another, the internal walls of the plurality of internal walls skewed relative to the external walls of the plurality of external walls.

11. The refrigerator of claim 10, wherein the plurality of internal walls extend into the airflow path at an obtuse angle.

12. The refrigerator of claim 11, wherein the obtuse angle is at least 100 degrees.

13. The refrigerator of claim 11, wherein the obtuse angle is 100 degrees.

14. A method of operating the refrigerator of claim 10, the method comprising reducing a drag on airflow passing along the airflow path from the inlet to the outlet with the skewed internal walls.

15. The refrigerator of claim 1, wherein the inlet and outlet for the airflow path are at a front of the component subassembly and the airflow path includes a first portion on a first lateral side of the central internal wall and a second portion on a second lateral side of the central internal wall, the first portion of the airflow path extending in a rearward direction from the inlet into the component subassembly, the second portion of the airflow path extending in a forward direction to the outlet of the airflow path.

16. The refrigerator of claim 15, wherein the plurality of angled internal walls extend into the airflow path at obtuse angles.

17. The refrigerator of claim 1, wherein the plurality of angled internal walls along the first portion of the airflow path are angled to extend laterally inward and rearward, and the plurality of angled internal walls along the second portion of the airflow path are angled extend laterally inward and forward.

18. A refrigerator comprising:

a cabinet that defines an interior volume, the interior volume defining at least one cooling compartment;

at least one door carried by the cabinet for accessing the interior volume;

a component subassembly located below the at least one cooling compartment and incorporating a plurality of refrigeration components, the plurality of refrigeration components including a compressor, a condenser and a fan, the component subassembly including a plurality of walls defining an airflow path extending between an inlet for colder air and an outlet for warmer air, the inlet and outlet located at a front of the component subassembly, the plurality of walls including:

a plurality of external walls oriented orthogonal to one another;

a central internal wall separating a first portion of the airflow path on a first lateral side of the central internal wall and in direction communication with the inlet from a second portion of the airflow path on a second lateral side of the central internal wall and in direction communication with the outlet;

a first plurality of angled internal walls extends into the first portion airflow path, the first plurality of angled internal walls along the first portion of the airflow path angled to extend laterally inward and rearward; and a second plurality of angled internal walls extends into the second portion airflow path, the second plurality of angled internal walls along the second portion of the airflow path angled to extend laterally inward and forward.

* * * * *